US007536970B1

(12) United States Patent
McCoy et al.

(10) Patent No.: US 7,536,970 B1
(45) Date of Patent: May 26, 2009

(54) PORTABLE HYDRAULIC MASTER RATCHET

(76) Inventors: Patrick M McCoy, 407 Aloha Ct., Abita Springs, LA (US) 70420; William H Hiller, III, 407 Aloha Ct., Abita Springs, LA (US) 70420

( * ) Notice: Subject to any disclaimer, the term of this patent is extended or adjusted under 35 U.S.C. 154(b) by 0 days.

(21) Appl. No.: 11/938,631

(22) Filed: Nov. 12, 2007

(51) Int. Cl.
*B63B 21/04* (2006.01)

(52) U.S. Cl. ..... 114/251; 294/82.27; 294/82.34

(58) Field of Classification Search ..... 114/242, 114/248, 249, 250, 251, 252, 259; 294/82.27, 294/82.3, 82.34
See application file for complete search history.

(56) References Cited

U.S. PATENT DOCUMENTS 1,231,067 A * 6/1917 Sansom ..... 114/251
2,220,288 A 11/1940 Sarosdy
2,651,386 A * 9/1953 Rossell ..... 188/295
2,818,229 A * 12/1957 Guthans ..... 114/251
2,917,018 A * 12/1959 Knight ..... 114/251
3,050,800 A * 8/1962 Kernahan ..... 114/252
3,338,359 A 8/1967 Bailie et al.
3,785,324 A * 1/1974 Guthans ..... 254/98
3,937,163 A * 2/1976 Rosenberg ..... 114/259
3,949,699 A 4/1976 Heese et al.
4,100,875 A 7/1978 Patterson, III et al.
4,165,705 A 8/1979 Yoshikai
4,487,442 A * 12/1984 Grapes et al. ..... 294/82.34
4,540,210 A * 9/1985 Smith ..... 294/82.34
4,826,229 A * 5/1989 Smith ..... 294/82.27
4,938,163 A 7/1990 Capron
4,947,778 A 8/1990 Fahrner
5,072,685 A 12/1991 Kancic
5,735,228 A 4/1998 Huang
6,463,869 B2 10/2002 Smith
6,487,985 B1 12/2002 Kuhlman

* cited by examiner

*Primary Examiner*—Lars A Olson
(74) *Attorney, Agent, or Firm*—Michael I. Kroll

(57) ABSTRACT

A manually actuated hydraulic cylinder with a retractable piston for varying the distance between two cables secured to a barge attachment ring on the end of the cylinder and a pelican hook and keeper disposed on the end of the piston as used in the marine industry for coupling barges.

5 Claims, 8 Drawing Sheets

10

| NOMENCLATURE OF THE "MASTER RATCHET" | |
|---|---|
| BARGE ATTACHMENT RING 26 | ATTACHED FITTING FOR CONNECTING SHACKLE TO THE "D" RING ON A BARGE. |
| HYDRAULIC FLUID FILLER HOLE 28 | FILLER HOLE FOR HYDRAULIC FLUID. |
| VALVE 16 | PRESSURE RELEASE |
| HANDLE 30 | FOR RETRACTING PISTON INTO HYDRAULIC CYLINDER. |
| HYDRAULIC CYLINDER 17 | REVERSIBLE |
| PISTON 18 | WITH HYDRAULIC CYLINDER |
| THREADS 20 | ON PISTON TO ADJUST PELICAN HOOK AND CHANGE KEEPER. |
| KEEPER 24 | TO KEEP PELICAN HOOK IN A CLOSED POSITION. |
| PELICAN HOOK 22 | TO KEEP WIRE SLINGS LOCKED IN PLACE. |
| LEGS 14 | TO HOLD RATCHET OFF OF THE SURFACE OF THE DECK AND FACILITATE RETRACTION OF PISTON INTO CYLINDER. |

FIG. 6

PORTABLE HYDRAULIC MASTER RATCHET

BACKGROUND OF THE INVENTION

1. Field of the Invention

The present invention relates generally to marine type ratchets used for rigging, tying down, bracing, mooring, securing and towing and, more specifically, to a master ratchet widely used in the marine industry designed for securing the connection between barges into what is termed "tows". The device is a vital piece of equipment in this industry. The master ratchet employs hydraulics and is designed to make a vital operation carried out hundreds of times daily on our waterways safe and efficient. As a result companies become more productive and profitable with fewer injuries to employees.

2. Description of the Prior Art

There are other devices designed for hydraulics. Typical of these is U.S. Pat. No. 2,220,288 issued to Sarosdy on Nov. 5, 1940.

Another patent was issued to Baillie, et al. on Aug. 29, 1967 as U.S. Pat. No. 3,338,359. Yet another U.S. Pat. No. 3,949,699 was issued to Heese, et al. on Apr. 13, 1976 and still yet another was issued on Jul. 18, 1978 to Patterson, III, et al. as U.S. Pat. No. 4,100,875.

Another patent was issued to Yoshikai, et al. on Aug. 28, 1979 as U.S. Pat. No. 4,165,705. Yet another U.S. Pat. No. 4,938,163 was issued to Capron on Jul. 3, 1990. Another was issued to Fahrner on Aug. 14, 1990 as U.S. Pat. No. 4,957,778 and still yet another was issued on Dec. 17, 1991 to Kaucic as U.S. Pat. No. 5,072,685.

Another patent was issued to Huang on Apr. 7, 1998 as U.S. Pat. No. 5,735,228. Yet another U.S. Pat. No. 6,487,985 was issued to Kuhlman on Dec. 3, 2002. Another was issued to Smith on Oct. 15, 2002 as U.S. Pat. No. 6,463,869.

A steamboat ratchet comprising a tubular housing, a nut in each end of the housing, a screw threaded into each nut, abutments carried on the housing: against which the nuts bear when the screws are subjected to tension, the inner ends of said nuts being at an oblique angle to the axis thereof, a spacer tube in said housing extending between said nuts, said spacer tube also having its ends at an oblique angle to its axis and engaging the inner ends of said nuts whereby to cause rotation thereof with said spacer tube, and means securing said spacer tube to said housing.

In a ratchet-type load binder of a type having a double-ended pawl pivotally mounted on a load binder handle for selective engagement in either of two adjusted positions with a load binder ratchet wheel; pawl control mechanism including first socket engagement means formed in the pawl spaced from and extending parallel with the pawl pivot axis and movable with the pawl; similar second socket engagement means formed in the handle extending parallel with the first socket engagement means and the pawl pivot axis, and fixed in spaced relation with respect to said pawl pivot axis; a pair of similar pressure members, each pressure member having a shank, a boss at one shank end having a cylindrical portion extending at 90° with respect to the axis of the shank, and a shoulder formed at the intersection of the shank with the boss; a coil spring member having end portions; the pair of pressure members being assembled with the coil spring member with pressure member shanks received in opposed spaced relation within end portions of the spring and with the spring end portions seated on said pressure member shoulders; the boss of one pressure member being seated in the first socket means; and the boss of the other pressure member being seated in the second socket means.

A method of and apparatus for connecting two vessels, such as a tugboat and a barge, to form a composite vessel, are disclosed. The method uses hydraulically powered apparatus completely controlled from one of the vessels to extend a shaft from one vessel toward the other vessel which has apparatus to capture the extended shaft. The method accommodates substantial misalignment between the vessels being connected by permitting lateral adjustment during connection. The apparatus for effecting the connection includes an active member carried by one of the vessels and a passive member carried by the other of the vessels. The active member is hydraulically actuated, includes a longitudinally reciprocable shaft which is actuated by a powered toggle linkage, and includes a release mechanism. The passive member is carried by the other of the vessels and automatically engages the shaft of the active member. The toggle linkage establishes a latching mechanism which does not require separate locking members and which does not fail in the event of pressure loss or hydraulic fluid leakage.

A connector for barges and the like is provided in the form of a threaded ratchet tube, a central ratchet drive for rotating said tube, an annular drive wheel surrounding and connected to said tube for rotating the same, separate right and left hand threaded screw members having one end threaded into said tube, fastening means on the other end of each said screw members and removable anchor means adapted to engage a surface over which the ratchet tube extends engaging one of said fastening means and holding said tube above said surface a distance greater than the radius of said annular drive wheel.

The coupling mechanism comprises a pair of spaced connecting rods secured to the stern of a barge and apparatus mounted on the tug for receiving the connecting rods. The rod receiving apparatus comprises a pair of vertical circular disc members each having a diameter smaller than the spacing between the connecting rods. Contact members are secured to the peripheries of the circular disc members to form a V shaped groove therebetween for receiving the connecting rods. The circular disc members are urged toward each other by a spring, and stop members are provided to limit the rotational movement of the circular disc members. A cushion member is provided to absorb the shock created when the tug and barge are coupled together. Further, a holding device is provided for holding the coupling mechanism in an operative state or in an inoperative state.

A barge connecting system for connecting a first vessel to a second vessel comprising three spaced parallel rectangular shaped plates, the first plate of which is attached to the stem of a lead vessel, and the third plate of which abuts or may be attached to the bow of a following vessel. Bracing for the second and third plates is provided by plurality of diagonal wire cables each of which has one end connected to a corner of the first rectangular shaped plate and the opposite end connected to either a corner of the second rectangular shaped plate or a corner of the third rectangular shaped plate. Positioned vertically between the first and second plates are a first pair of pneumatic fenders which are rotatably mounted on the first plate by wire cables. There is positioned horizontally between the second and third plates a second pair of pneumatic fenders which are mounted on third plate by wire cables. The fenders allow horizontal movement of the second and third plates with respect to the first plate and vertical movement of third plate with respect to the first and second plates. Since the fenders are pneumatic, a surge force generated by the following vessel will be absorbed, the fenders will then expand and the following vessel will return to an equilibrium position with respect to the lead vessel. At least a pair of tow lines are used to connect to stem of the lead vessel to the bow of the following vessel when said third rectangular shaped plate is not attached to the bow of said following vessel.

An apparatus for interconnecting a pair of barges, or other waterborne vessels, to facilitate hookup and release of barges in an "on-hip" arrangement with a powered vessel. Oriented on the bow of each barge, coincident with the barge's longitudinal center line, is a bracket terminating in a socket. A pivot shaft with an upper ball adapted to fit in the socket is provided with a lower trunion to support a bridge element whereby two barges may be connected. The bridge element is free to rotate in a horizontal plane about the pivot shafts to allow swinging movement of the barges and the ball-in-socket fitting allows a limited range of independent movement for the barges such as in swells. Movement limiting fenders and chains are provided to control swing of the barges. Such an apparatus allows a single tug or dredge to rapidly make up a dual barge push towing arrangement.

Hydraulic system for controlling tug-barge cables. A closed hydraulic loop is connected to a cylinder and includes a pump to reciprocate the piston and to apply constant tension through the cylinder and piston to the cables.

A barge linking system which includes a pair of flexible connector assemblies stored on board a rear pontoon of a pair pontoons to be connected at sea. Each flexible connector assembly has a forward housing and a rear housing which are connected by a shear pin and rotate about the shear pin. Attached to the front end of the forward housing is flexible rubber sleeve which encases a substantial portion of a chain sling. The front end of the chain sling, which extends from the rubber sleeve, has a master link which allows the chain sling to be connected to a cable from a winch on board the forward pontoon. The rear housing of the flexible connector assembly has a chain shackle which allows the rear housing to be connected to a cable from a winch on board the rear pontoon. The forward housing has a pair of slots which align with a pair of slots in the forward pontoon, while the rear housing has a pair of slots which align with a pair of slots in the rear pontoon. A first guillotine collar is inserted into the aligned slots of the forward housing and first pontoon to secure the forward pontoon to the forward housing. A second guillotine collar is inserted into the aligned slots of the rear housing and rear pontoon to secure the forward pontoon to the forward housing of the connector assembly.

A connection apparatus is provided for connecting a ram of a pusher vessel with a receiver installed in a stem notch of a barge, the connection head for mounting on the ram having a generally pentagonal shape and the receiver having two opposed side walls with one side wall being flat and the other side wall having projecting teeth.

A reciprocating barge coupling device for removably coupling adjacent barges floating on a water body and allowing vertical movement of the barges with respect to each other typically due to the wave-induced rise and fall of the barges. In a preferred embodiment the reciprocating barge coupling device is characterized by a pair of coupling units of substantially identical construction mounted on the responsive barges, each of which coupling units is fitted with an elongated, vertical coupling channel and a T-bolt. In application, the barges are positioned in adjacent, end-to-end relationship to each other, with the vertical coupling channels of the respective coupling units in substantially aligned, facing relationship with respect to each other. The T-bolt of one of the coupling units can be selectively extended through the registering coupling channels of both coupling units, rotated to cause engagement of the T-bolt head with the opposite coupling unit and locked in place, to removably couple the barges to each other. Accordingly, the extended T-bolt is capable of bidirectional vertical movement in the coupling channel of the receiving coupling unit, and the floating barges remain coupled to each other as the barges rise and fall with respect to each other in the water.

While these ratchet devices may be suitable for the purposes for which they were designed, they would not be as suitable for the purposes of the present invention, as hereinafter described.

SUMMARY OF THE PRESENT INVENTION

A primary object of the present invention is to provide a marine type ratchets used for rigging, tying down, bracing, mooring, securing and towing of barges.

Another object of the present invention is to provide a master ratchet widely used in the marine industry designed for securing the connection between barges into what is termed "tows".

Yet another object of the present invention is to provide a master ratchet that employs hydraulics and is designed to make a vital operation carried out hundreds of times daily on our waterways safe and efficient. As a result companies become more productive and profitable with fewer injuries to employees.

Still yet another object of the present invention is to provide a master ratchet that as a result of its qualities companies will become more productive and profitable with fewer injuries to employees.

Additional objects of the present invention will appear as the description proceeds.

The present invention overcomes the shortcomings of the prior art by providing a master ratchet widely used in the marine industry designed for securing the connection between barges into what is termed "tows". The device is a vital piece of equipment in this industry. The master ratchet employs hydraulics and is designed to make a vital operation carried out hundreds of times daily on our waterways safe and efficient. As a result companies become more productive and profitable with fewer injuries to employees.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 6 is a chart of the present invention of nomenclature;

DESCRIPTION OF THE REFERENCED NUMERALS

Figure 1:
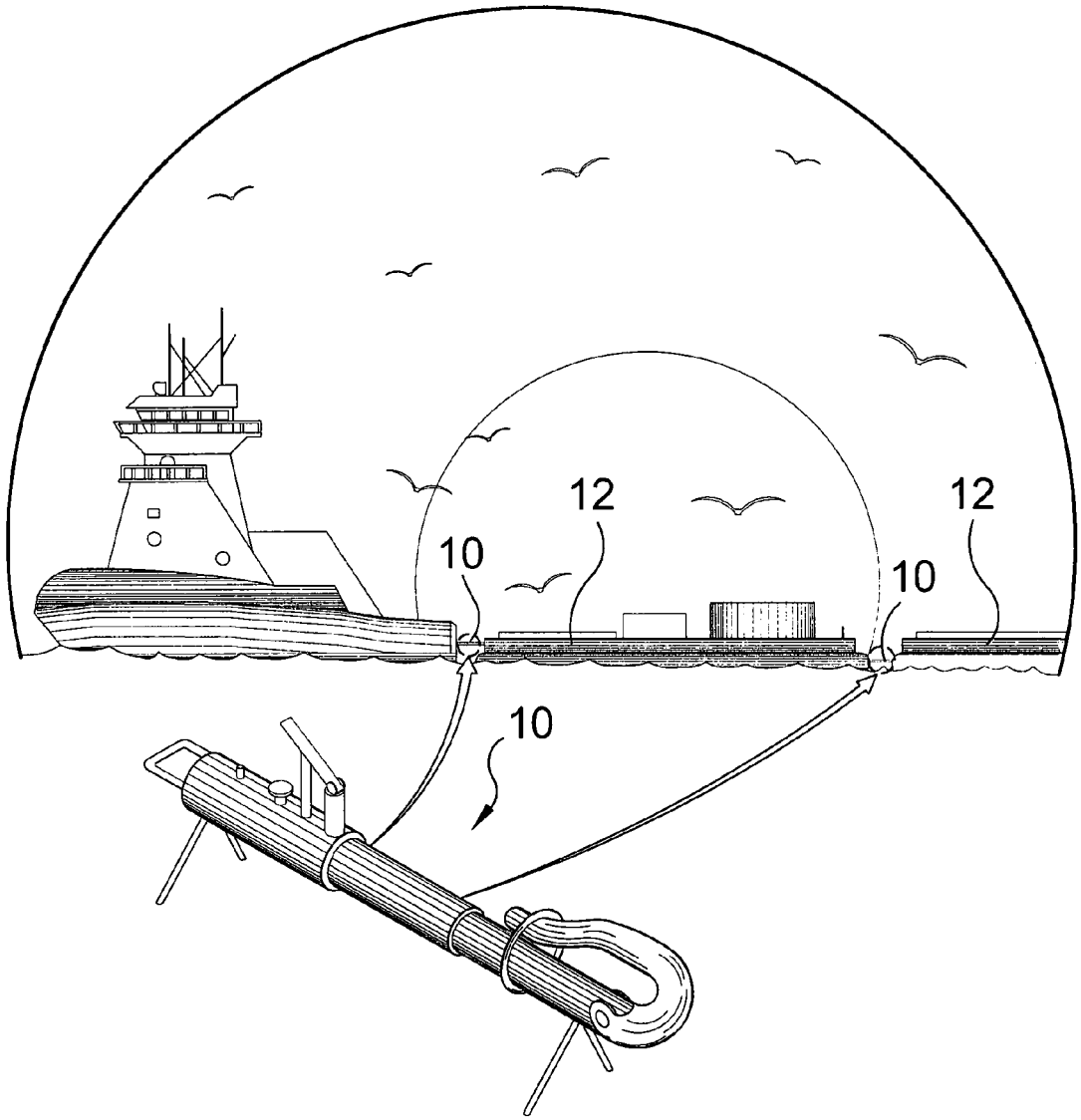
FIG. 1 is an illustrative view of the present invention.

Turning now descriptively to the drawings, in which similar reference characters denote similar elements throughout the several views, the figures illustrate the Portable Hydraulic Master Ratchet of the present invention. With regard to the reference numerals used, the following numbering is used throughout the various drawing figures.

10 Portable Hydraulic Master Ratchet of the present invention
12 barge
14 leg
16 pressure release valve
17 hydraulic cylinder
18 retractable piston
20 threads
22 pelican hook
24 keeper
26 barge attachment ring
28 hydraulic fluid filler hole
30 handle retracting piston into hydraulic cylinder
32 reversible hydraulic cylinder
34 shackle
36 sling
38 deck surface

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10. The present invention is a master ratchet 10 designed for a mechanical piece of equipment widely used in the marine industry. The ratchet is used to tie barges 12 together into what is termed "tows". The device is a vital piece of equipment used with massive steel cables and manpower combined with principles of leverage to achieve the connection of barges 12 together.

Figure 2:
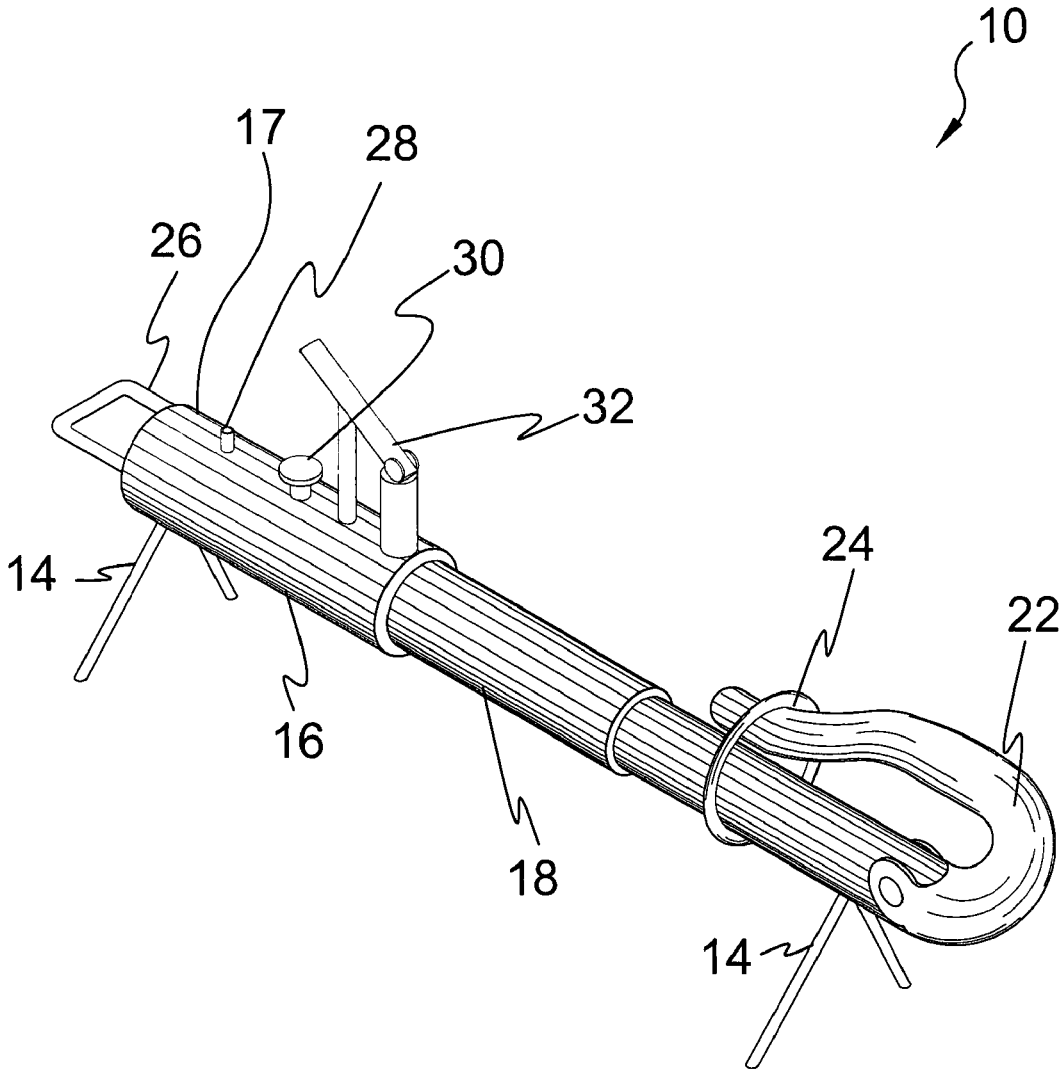
FIG. 2 is a perspective view of the present invention.

FIG. 2 is a perspective view of the present invention 10. The present invention is a manually actuated hydraulic cylinder 17 with a retractable piston 18 for varying the distance between two cables secured to a barge attachment ring 26 on the end of the cylinder 32 and a pelican hook 22 and keeper 24 disposed on the end of the piston 18 as used in the marine industry for coupling barges. The cylinder 17 includes a hydraulic fluid filler hole 28, a pressure release valve 16, a handle retracting piston 30 and a reversible hydraulic cylinder 32. Said device has legs 14 for spacing the device from a surface.

Figure 3:
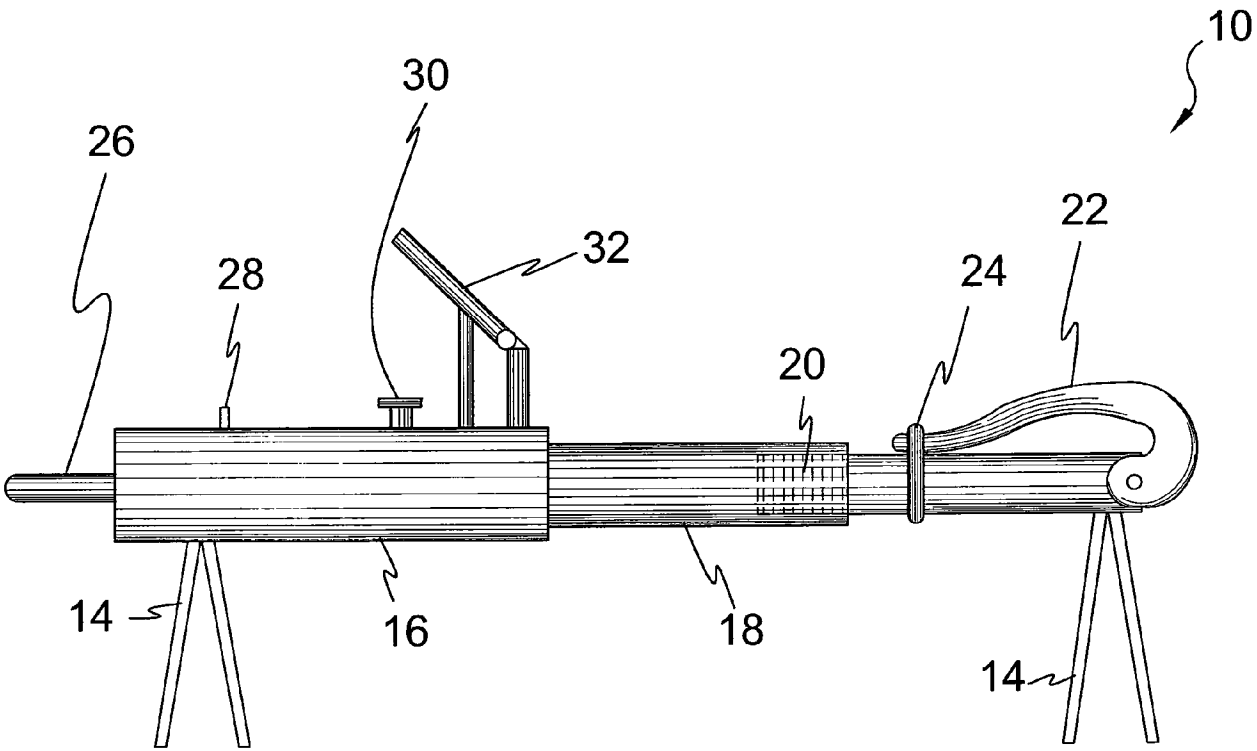
FIG. 3 is an orthographic view of the present invention.

FIG. 3 is an orthographic view of the present invention 10. The present invention 10 is a manually actuated hydraulic cylinder 17 with a retractable piston 18 for varying the distance between two cables secured to a barge attachment ring 26 on the end of the cylinder 32 and a pelican hook 22 and keeper 24 disposed on the end of the piston 18 as used in the marine industry for coupling barges. The cylinder 17 includes a hydraulic fluid filler hole 28, a pressure release valve 16, a handle retracting piston 30 and a reversible hydraulic cylinder 32. The pelican hook 22 could be threaded 20 into the piston 18. Said device having legs 14 for spacing the device from a surface. The device addresses the safety issue by eliminating the need for manpower to use leverage in order to achieve a tight connection between the barges, therefore eliminating injuries to workers.

Figure 4:
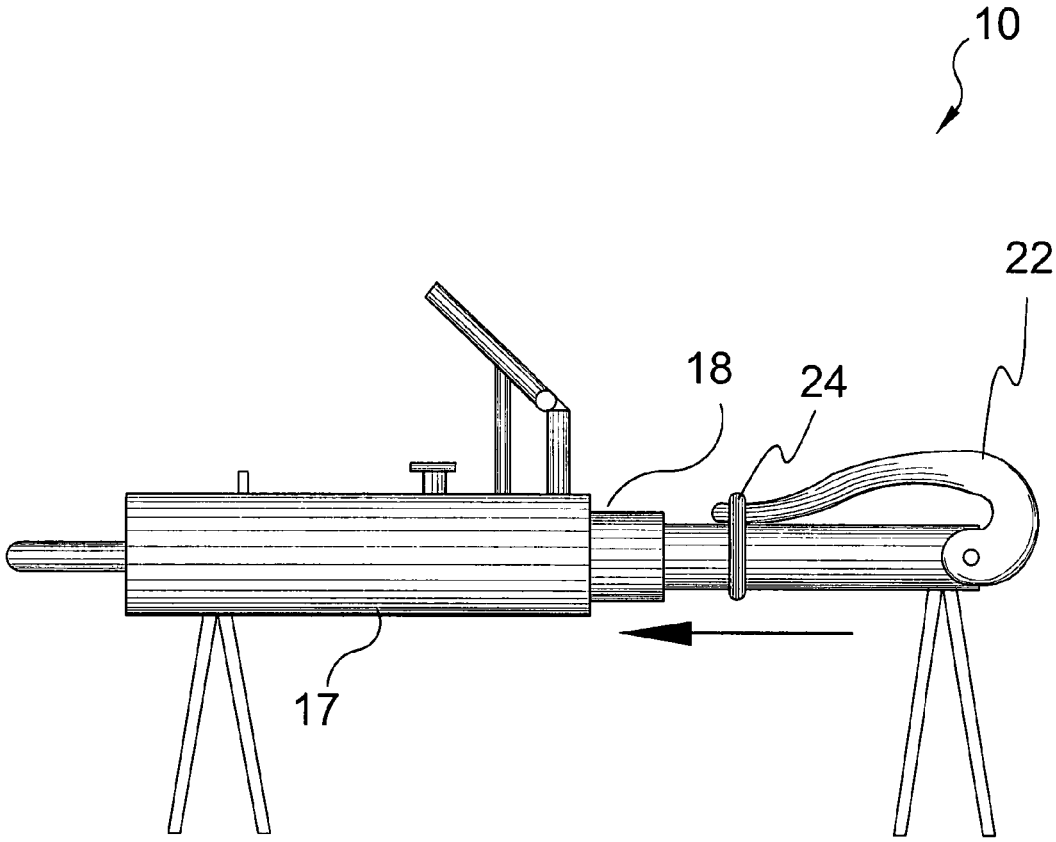
FIG. 4 is an orthographic view of the present invention retracted.

FIG. 4 is an orthographic view of the present invention 10 retracted. Shown is the present invention 10 showing the piston 18 retracted into the cylinder 18 and the pelican hook 22 secured by the keeper 24. The device eliminates the need for manpower to use leverage in order to achieve a tight connection between the barges.

Figure 5:
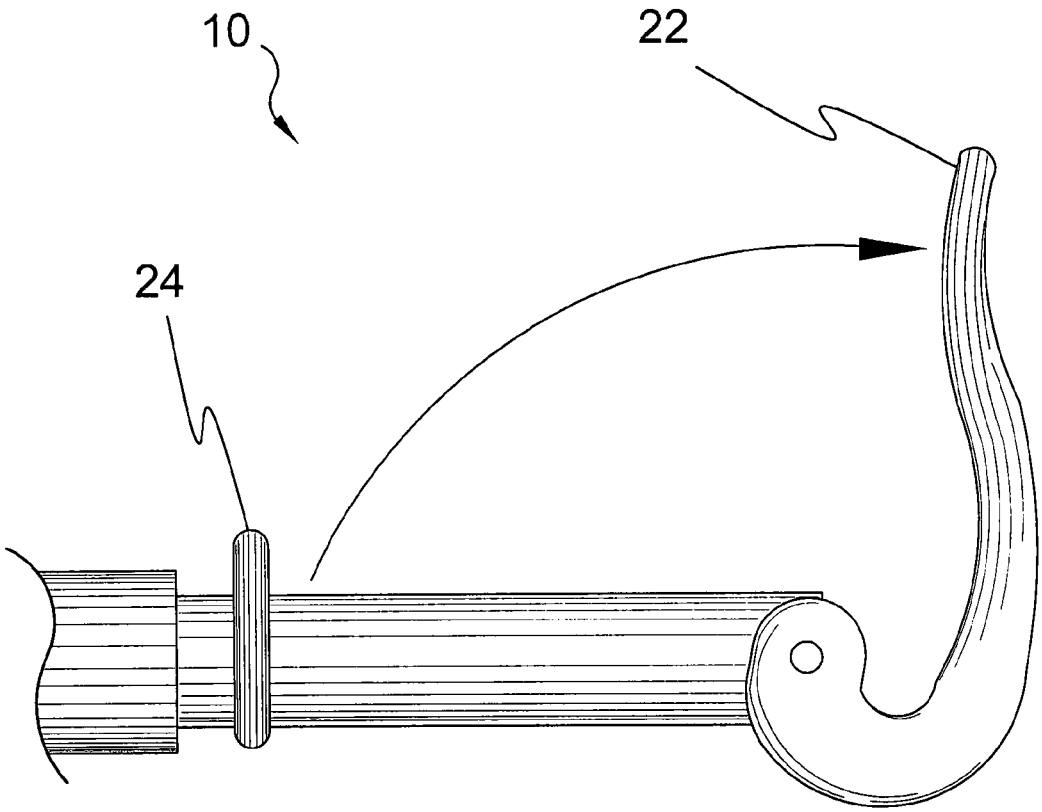
FIG. 5 is a detailed view of the pelican hook of the present invention in an open position.

FIG. 5 is a detailed view of the pelican hook 22 of the present invention 10 in an open position. The pelican hook 22 keeps the wire slings that connect barges together locked in position. Keeper rings 24 secure the pelican hook in a closed position.

FIG. 6 is a chart of the present invention 10 of nomenclature. Shown is a chart of nomenclature of the components providing part name and function for further understanding of the hydraulic ratchet design. The components described include the legs 14, the pressure release valve 16, the hydraulic cylinder 17, the piston 18, the optional threads 20 for the pelican hook 22, the keeper 24, the barge attachment ring 26 and the hydraulic fluid filler hole 28.

Figure 7:
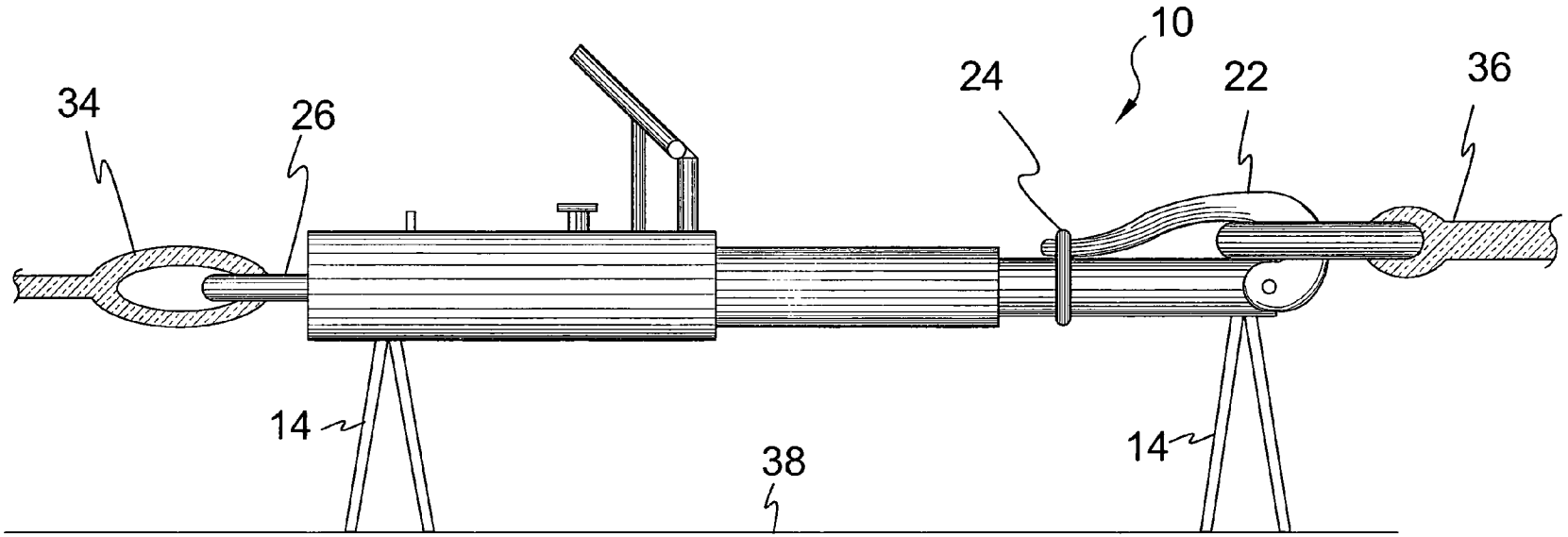
FIG. 7 is a side view of the present invention.

FIG. 7 is a side view of the present invention 10. Shown is the pelican hook 22 connected to the sling 36 and retained thereto by the keeper 24. The legs 14 keep the rest of the assembly raised above the deck surface 38. The device is a vital piece of equipment used with massive steel cables and manpower combined with principles of leverage to achieve the connection of barges together.

Figure 8:
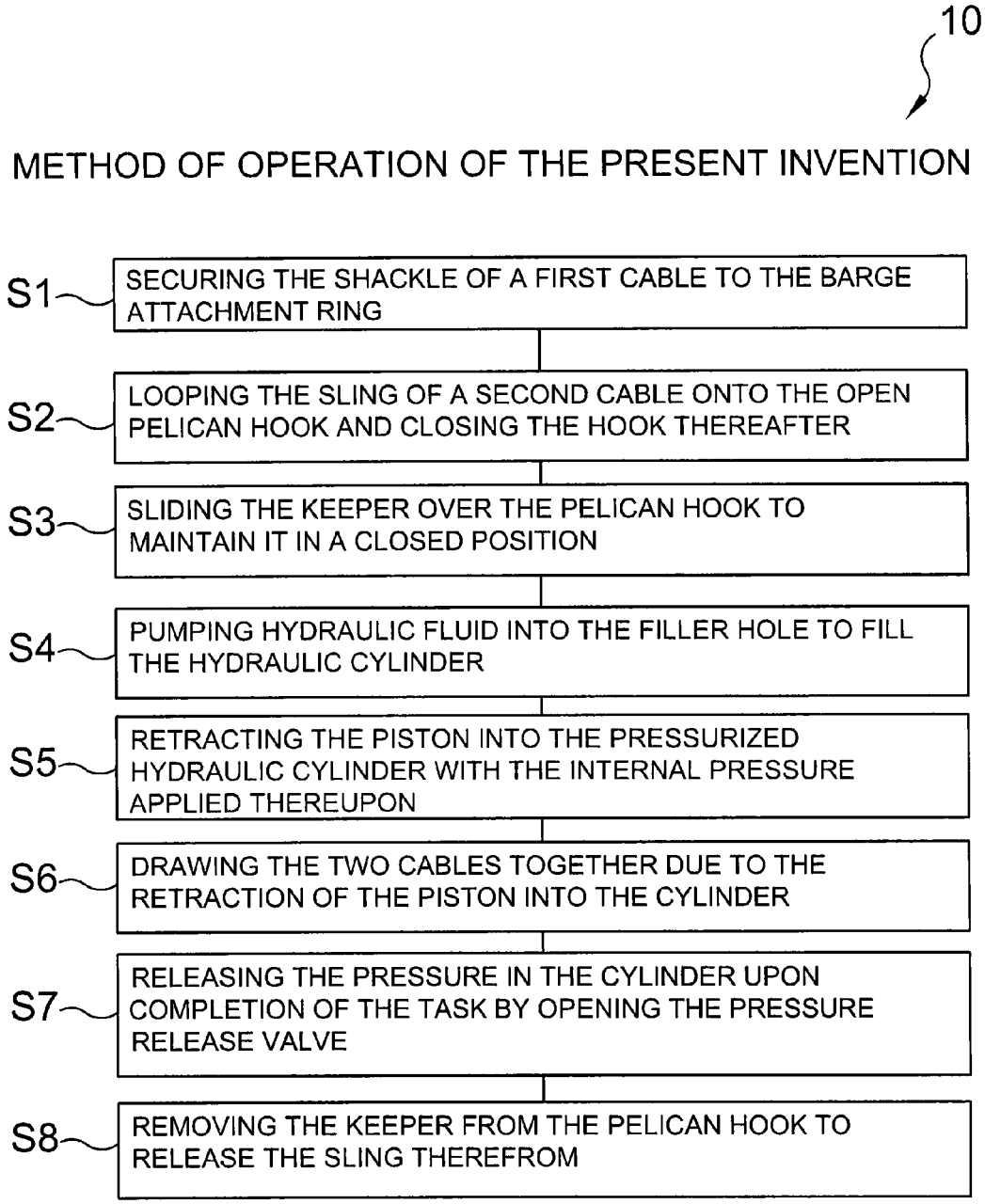
FIG. 8 is a block diagram demonstrating the method of operation of the present invention.

FIG. 8 is a block diagram demonstration the method of operation of the present invention 10.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is new and desired to be protected by letters patent is set forth in the appended claims:

1. A portable hydraulic ratchet for drawing two linearly opposing cables toward one another, said ratchet comprising:

a) a hydraulic cylinder;

b) a reversible piston that selectively travels reciprocatively within said cylinder;

c) a barge attachment ring disposed at the distal end of said cylinder;

d) a releasable means for securing a sling of a steel cable to the distal end of said piston;

e) wherein said releasable sling securing means is a pelican hook that receives said cable sling thereon when in an open position;

f) wherein said pelican hook is secured in a closed position by at least one keeper ring;

g) wherein a "D-ring" of a shackle of the opposing cable is secured to said barge attachment ring on said hydraulic cylinder;

h) wherein said hydraulic cylinder includes a hydraulic filler hole to allow for the passage of hydraulic fluid therethrough;

i) wherein said hydraulic cylinder further includes a pressure release valve;

j) wherein said hydraulic cylinder further includes a handle retracting piston disposed circumferentially thereon for retracting said piston therein;

k) wherein said hydraulic cylinder further includes a reversible hydraulic cylinder disposed circumferentially thereon proximal to said handle retracting piston; and l) further including mating threads in said piston and on said pelican hook to adjust said pelican hook and for changing the keeper ring.

2. The portable hydraulic ratchet recited in claim 1, wherein said hydraulic cylinder and said piston each have a pair of leg members projecting angularly downward and outward proximal the respective distal ends thereof to hold the ratchet off a surface and to facilitate retraction of said piston into said hydraulic cylinder.

3. The portable hydraulic ratchet recited in claim 1, wherein said ratchet is used for securing the connection between barges into what is termed "tows".

4. The portable hydraulic ratchet recited in claim 1, wherein said ratchet application is selected from a group comprising rigging, tying down, bracing, mooring and securing barges.

5. A method of operation for using the portable hydraulic master ratchet of claim 1, to secure the connection between the cables depending from two adjacent barges for tows, comprising sequentially following the steps of:

a) securing the shackle of a first cable to the barge attachment ring disposed on the distal end of a hydraulic cylinder;

b) opening the pelican hook and looping the sling of a second cable onto the pelican hook;

c) closing the hook thereafter;

d) sliding the at least one keeper ring over said pelican hook to retain it in a closed position;

e) pumping hydraulic fluid into the filler hole to fill the hydraulic cylinder;

f) manually pressurizing said hydraulic fluid within said hydraulic cylinder;

g) retracting said reversible piston into the pressurized hydraulic cylinder with the internal pressure applied thereupon;

h) drawing the two cables and their respective barges together due to the retraction of the piston into the cylinder;

i) releasing the pressure in the cylinder upon completion of the task at hand by opening the pressure release valve; and j) removing the at least one keeper ring from the pelican hook to release the sling therefrom.

* * * * *